US006881279B2

(12) United States Patent
Meagher et al.

(10) Patent No.: US 6,881,279 B2
(45) Date of Patent: Apr. 19, 2005

(54) HIGH PERFORMANCE NON-CHROME PRETREATMENT FOR CAN-END STOCK ALUMINUM

(75) Inventors: Kevin K. Meagher, Northville, MI (US); Thomas J. Prescott, Troy, MI (US); Timm L. Kelly, Birmingham, MI (US)

(73) Assignee: Henkel Corporation, Gulph Mills, PA (US)

( * ) Notice: Subject to any disclaimer, the term of this patent is extended or adjusted under 35 U.S.C. 154(b) by 40 days.

(21) Appl. No.: 10/316,403

(22) Filed: Dec. 11, 2002

(65) Prior Publication Data

US 2004/0112470 A1 Jun. 17, 2004

(51) Int. Cl.[7] ..... C23C 22/07; C04B 9/02; C09K 3/00; B32B 15/04

(52) U.S. Cl. ..... 148/259; 148/243; 148/253; 106/14.12; 252/389.2; 252/393; 252/394; 428/472.3

(58) Field of Search ..... 148/243, 253, 148/259; 106/14.12; 252/389.2, 393, 394; 428/472.3

(56) References Cited

U.S. PATENT DOCUMENTS

| | | | | |
|---|---|---|---|---|
| 4,148,670 A | | 4/1979 | Kelly | |
| 4,376,000 A | | 3/1983 | Lindert | |
| 4,433,015 A | | 2/1984 | Lindert | |
| 4,457,790 A | | 7/1984 | Lindert et al. | |
| 4,517,028 A | | 5/1985 | Lindert | |
| 4,963,596 A | | 10/1990 | Lindert et al. | |
| 4,970,264 A | | 11/1990 | Lindert et al. | |
| 4,992,116 A | * | 2/1991 | Hallman | 148/247 |
| 5,039,770 A | | 8/1991 | Lindert et al. | |
| 5,068,299 A | | 11/1991 | Lindert et al. | |
| 5,116,912 A | | 5/1992 | Lindert et al. | |
| 5,266,410 A | | 11/1993 | Lindert et al. | |
| 5,298,289 A | | 3/1994 | Lindert et al. | |
| 5,342,456 A | | 8/1994 | Dolan | |
| 5,891,952 A | | 4/1999 | McCormick et al. | |
| 5,897,716 A | | 4/1999 | Reghi et al. | |
| 5,935,348 A | * | 8/1999 | Rossmaier | 148/243 |

FOREIGN PATENT DOCUMENTS

| | | | | |
|---|---|---|---|---|
| GB | 2 165 165 A | | 4/1986 | |
| GB | 2165165 A | * | 4/1986 | B05D/1/36 |

* cited by examiner

*Primary Examiner*—John P. Sheehan
(74) *Attorney, Agent, or Firm*—Stephen D. Harper; Mary K. Cameron

(57) ABSTRACT

A chemically and thermally stable chromate free aqueous liquid treatment for metals, especially aluminum, that imparts corrosion resistance as good as that from conventional chromate containing treatments, contains water and a fluoroacid selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof; a water soluble organic carboxylic acid that contains at least two hydroxyl groups, exclusive of the hydroxyl groups that are part of any carboxyl groups, per carboxyl group in each acid molecule, the water soluble salts of such acids, and mixtures thereof; a source of phosphate ions; and an organic component selected from the group consisting of tannins and amino-phenolic polymers.

30 Claims, No Drawings

HIGH PERFORMANCE NON-CHROME PRETREATMENT FOR CAN-END STOCK ALUMINUM

1. FIELD OF THE INVENTION

In at least one aspect, the present invention relates to processes of treating metal surfaces with aqueous acidic compositions to increase corrosion resistance, and more particularly to processes of treating metal surfaces with aqueous acidic compositions that include phosphate ions to increase corrosion resistance and adhesion of an organic to said metal surfaces.

2. BACKGROUND ART

Can-ends are formed in a continuous process by presses that form the can-end and a transfer belt that transfers the can end blanks. The transfer belt supports the can ends during stamping and transports the can-ends away from the stamping station. Can-ends are typically made from aluminum and various aluminum alloys. Often, can-ends are made from a different alloy than the can body. Prior to forming, the metal stock needs to be cleaned, pretreated and over-coated with a protective coating in order to render the can-ends chemically resistant. Over-coats typically include vinyl, acrylic, epoxy, and polyester based paints, enamels, lacquers, and the like.

Cleaning and pretreatment compositions for aluminum and other metallic surfaces are typically aqueous acidic or alkaline compositions that may contain added chromium and fluoride. Furthermore, many of the compositions for treating metallic surfaces taught in the prior art contain hexavalent chromium or other inorganic oxidizing agents which are environmentally undesirable.

An improved composition and method of treating metallic surfaces which does not contain hexavalent chromium is provided in U.S. Pat. No. 5,897,716 (the '716 patent.) The '716 patent provides an aqueous metal-treating composition that includes a fluoroacid and a water soluble organic acid. The composition of the '716 patent also optionally includes a polymer composition, a pH adjusting component, an inorganic acid that contains fluorine, an antifoaming agent, and a component selected from the metals Ti, Zr, Hf, Al, Si, Ge, Sn, and B, and oxides, hydroxides, and carbonates of these metals. However, the '716 does not appreciate the inclusion of phosphates in a metal-treating composition for obtaining improved corrosion resistance.

Accordingly, there exists a need for metal treatments that do not contain undesirable components while providing improved corrosion resistance and adhesion to metal surfaces.

SUMMARY OF THE INVENTION

The present invention overcomes the problems encountered in the prior art by providing in one embodiment an aqueous acidic composition that includes a phosphate ion source. The composition of the present invention is in one aspect an improvement over the compositions of U.S. Pat. No. 5,897,716. The entire disclosure of this patent, except to the extent contrary to any explicit statement herein, is hereby incorporated by reference. The composition of the present invention is useful for treating metal surfaces to increase the resistance to corrosion of the treated metal surfaces. The composition of the present invention comprises:

(A) a fluoroacid selected from the group consisting of $H_2TiF_6$, $H_2ZrF_6$, $H_2HfF_6$, $H_2SiF_6$, $H_3AlF_6$, $H_2GeF_6$, $H_2SnF_6$, $HBF_4$, and mixtures thereof;

(B) a water soluble organic carboxylic acid that has at least two hydroxyl groups, exclusive of the hydroxyl groups that are part of any carboxyl groups, per carboxyl group in each acid molecule and the water soluble salts of such acids;

(C) a source of phosphate ions (i.e., $PO_4^{3-}$); and (D) an organic component selected from the group consisting of a tannin, an amino-phenolic polymer, and mixtures thereof.

The composition of the present invention optionally further comprises one or more of the following:

(E) a metal-containing component selected from the group consisting of the elements Ti, Zr, Hf, Al, Si, Ge, Sn, and B and the oxides, hydroxides, and carbonates of all of these elements;

(F) a pH adjusting component selected from the group consisting of inorganic acids and inorganic alkaline materials that do not contain fluorine;

(G) an inorganic acid that has fluorine, but do not include any of the elements Ti, Zr, Hf, Al, Si, Ge, Sn, and B, and the salts of all such acids; and (H) an anti-foam agent in a sufficient amount to reduce foaming.

The compositions, after adjustment if necessary to appropriate concentration ranges of the active ingredients, are suitable for treating metal surfaces to achieve excellent resistance to corrosion, particularly after subsequent conventional coating with an organic binder containing protective coating. The compositions are particularly useful on iron and steel, galvanized iron and steel, zinc and those of its alloys that contain at least 50 atomic percent zinc, and, most preferably, aluminum and its alloys that contain at least 50, or still more preferably at least 90, atomic percent of aluminum.

In another embodiment of the present invention, a method for treating metal surfaces with the compositions set forth above is provided. This method comprises contacting the metal with the composition of the present invention for a sufficient time to produce an improvement in the resistance of the surface to corrosion, and subsequently rinsing before drying. Such contact may be achieved by spraying, immersion, and the like as known to one skilled in the art of metal treating. After contacting the metal, the metal is removed from contact with this composition and rinsed with water. Preferably, the metal is next contacted with a polymer rinse. A preferred polymer rinse is an aqueous solution of Parcolene 88A commercially available from Henkel Surface Technologies located in Madison Heights, Mich. After drying, the treated metal surface is over-coated with a protective coating which includes, but is not limited to, vinyl, acrylic, epoxy, and polyester based paints, enamels, lacquers, and the like.

In addition to the compositions and methods described above, other embodiments of the invention include articles of manufacture that incorporate a coating formed by the method of the invention and concentrate compositions that are useful for making up working compositions according to the invention by dilution with water and/or for replenishing consumed ingredients in a working composition according to the invention that has been used to treat so much metal surface that its beneficial properties have been significantly diminished.

DETAILED DESCRIPTION OF THE PREFERRED EMBODIMENT(S)

Reference will now be made in detail to presently preferred compositions or embodiments and methods of the invention, which constitute the best modes of practicing the invention presently known to the inventors.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counter-ions to produce electrical neutrality for the composition as a whole (any counter-ions thus implicitly specified should preferably be selected from among other constituents explicitly specified in ionic form, to the extent possible; otherwise such counter-ions may be freely selected, except for avoiding counter-ions that act adversely to the objects of the invention); and the term "mole" and its variations may be applied to elemental, ionic, and any other chemical species defined by number and type of atoms present, as well as to compounds with well defined molecules.

The composition of the present invention comprises a fluoroacid selected from the group consisting of $H_2TiF_6$, $H_2ZrF_6$, $H_2HfF_6$, $H_2SiF_6$, $H_3AlF_6$, $H_2GeF_6$, $H_2SnF_6$, $HBF_4$, and mixtures thereof. Preferably, the fluoroacid is selected from the group consisting of $H_2TiF_6$, $H_2ZrF_6$, $H_2HfF_6$, $H_2SiF_6$, $HBF_4$, and mixtures thereof. More preferably, the fluoroacid is selected from the group consisting of $H_2TiF_6$, $H_2ZrF_6$, $H_2SiF_6$, and mixtures thereof; and most preferably the fluoroacid has at least some $H_2TiF_6$. The total concentration of the fluoroacid in a working composition is preferably from about 0.5 to about 100 millimoles per liter (hereinafter "mM."). The term "working composition" as used herein means a composition used for the actual treatment of metal surfaces. More preferably, the total concentration of fluoroacid component in a working composition is from about 3 to about 50 mM; and most preferably about 13 mM.

The composition of the present invention further comprises a water soluble organic carboxylic acid that has at least two hydroxyl groups, exclusive of the hydroxyl groups that are part of any carboxyl groups, per carboxyl group in each acid molecule and the water soluble salts of such acids. Preferably, these acids are monobasic acids with from three to twelve, more preferably from four to eight, still more preferably from five to seven carbon atoms. Independently, the acids in this component preferably have one hydroxyl group attached to each carbon atom that is not part of a carboxyl group. The most preferred material for this component is gluconic acid. This component reduces loss of titanium in a working composition that occurs with repeated contact with aluminum surfaces at temperatures above 35° C. and with the thermal instability that occurs when a working solution is heated to above 74° C. The water soluble organic carboxylic acid is preferably present a working composition in an amount of about 0.1 to about 20 mM. More preferably, the organic carboxylic acid is present in a working composition in an amount from about 1 to about 10 mM, and most preferably about 4.5 mM.

The composition of the present invention further comprises a source of phosphate ions. Suitable sources of phosphate ions include phosphoric acid, orthophosphoric acid, potassium phosphate, sodium phosphate, ammonium phosphate, alkali metal phosphates, and the like. The preferred source of phosphate ions is phosphoric acid. The source of phosphate is present in an amount such that from about 0.5 mM to about 20 mM of phosphate ions are present in a working solution. More preferably, a sufficient amount of the phosphate source is present such that about 5 mM to about 15 mM of phosphate ions are present in a working solution, and most preferably in an amount such that about 12 mM of phosphate ions are present in a working solution. These amounts are total phosphate ions and not necessarily free phosphate ions since these compounds may not be fully dissociated in solution. When the phosphate source is phosphoric acid, the preferred amount of phosphoric acid is formed by introducing about 1 ml of 75% phosphoric acid to about 10 ml of 75% phosphoric acid per 6 liters of working solution.

The composition of the present invention also includes an organic component selected from the group consisting of a tannin, an amino-phenolic polymer, and mixtures thereof. Suitable examples of such polymers include Mannich adducts of secondary amines containing a carbon chain with at least one hydroxy group, formaldehyde, and a polyphenolic resin. In some embodiments, the polymer composition is selected from the group consisting of water soluble and water dispersible polymers and copolymers of one or more x-(N—R1—N—R2-aminomethyl)-4-hydroxy-styrenes, where x=2, 4, 5, or 6, R1 represents an alkyl group containing from 1 to 4 carbon atoms, preferably a methyl group, and R2 represents a substituent group conforming to the general formula H(CHOH)nCH2—, where n is an integer from 1 to 7, preferably from 3 to 5. Certain preferred polymers are Mannich adducts of polyvinyl phenol that are described in more detail in U.S. Pat. Nos. 4,376,000; 4,433,015; 4,457,790; 4,517,028; 4,963,596; 4,970,264; 5,039,770; 5,068,299; 5,116,912; 5,266,410; 5,298,289; and 5,891,952, the entire disclosure of each patent, except to the extent contrary to any explicit statement herein, is hereby incorporated herein by reference. In certain embodiments, the polymer component is the Mannich adduct of polyhydroxystyrene with N-methylglucamine. Polymer, in some embodiments, can also be added as a solution of the polymer component with an acid, such as fluorotitanic acid, phosphoric acid, and fluorozirconic acid. When this component is used, its concentration in a working composition if maximum resistance to damage during deformation of the treated substrate is required is preferably from about 4.5 mg/L to 3000 mg/L. More preferably, the concentration of this component if from about 250 mg/L to about 2000 mg/L, and most preferably from about 530 mg/L to about 800 mg/L. If this greater resistance is not necessary, the preferred concentration is from about 4.5 mg/L to about 700 mg/L. More preferably in this variation the concentration is from about 150 mg/L to about 650 mg/L, and most preferably about 400 mg/L to about 600 mg/L. The term "tannin" as used herein refers to polyphenolic substances having molecular weights of from about 400 to about 3000. Tannins are classified as "hydrolyzable" or "condensed" depending upon whether the product of hydrolysis in boiling mineral acid is soluble or insoluble, respectively. Often tannin extracts are mixed and contain both hydrolyzable and condensed forms. Typically, no two tannin extracts are exactly alike. Principal sources of tannin extracts include bark such as wattle, mangrove, oak, eucalyptus, hemlock, pine larch, and willow; woods such as quebracho, chestnut, oak and urunday, cutch and turkish; fruits such as myrobalans, valonia, divi-divi, tera, and algarrobilla; leaves such as sumac and gambier; and roots such as canaigre and palmetto. The term "vegetable tannins" are mineral tanning materials such as those containing chromium, zirconium and the like. As used herein, the term "tannin" encompasses hydrolyzable, condensed, and mixed varieties of vegetable tannins which all may be used in the present invention. Quebracho and chestnut have been found to be very effective condensed tannins and myrobalan an effective hydrolyzable. A suitable tannin source is Bonderite 785-O which is a 0.62% dried chestnut tannin composition commercially available from Henkel Surface Technologies.

The composition of the present invention optionally further comprises a metal-containing component selected from the group consisting of the elements Ti, Zr, Hf, Al, Si, Ge, Sn, and B and the oxides, hydroxides, and carbonates of all of these elements.

The composition of the present invention also optionally includes a pH adjusting component, an inorganic acid that has fluorine but do not contain any of the elements Ti, Zr, Hf, Al, Si, Ge, Sn, and B, and an antifoaming agent. The pH adjusting component is selected from the group consisting of inorganic acids and inorganic alkaline materials that do not contain fluorine. Suitable inorganic acids include, but are not limited to, sulfuric acid, hydrochloric acid, and nitric acid, with nitric acid being generally preferred. If an alkaline material is needed to adjust pH, ammonium or alkali metal carbonates or bicarbonates are preferred. The pH adjusting component is added in a sufficient about so that the pH of a working solution is preferably from about 1.2 to about 4.5. More preferably the pH in a working solution is from about 2.0 to about 3.8, and most preferably from about 2.2 to about 3.2. Suitable inorganic acids having fluorine include, but are not limited to, hydrofluoric acid and/or acid fluoride salts such as ammonium bifluoride. Hydrofluoric acid is most preferred acid having fluorine. Generally these components are not needed in concentrates to be diluted with water to make working compositions, although a small amount of the pH adjusting component may often be needed to adjust the pH into the desired range in making working compositions. However, the inorganic acid that has fluorine and the antifoaming agent are commonly present in substantial amounts in replenishment concentrate compositions as set forth below.

It is normally preferred that compositions according to the invention as defined above should be substantially free from many ingredients used in compositions for similar purposes in the prior art. Such ingredient include hexavalent chromium; ferricyanide; ferrocyanide; peroxides and other oxidizing agents (the others being measured as their oxidizing stoichiometric equivalent as peroxide); and organic compounds having no carboxyl or carboxylate groups but two or more hydroxyl groups per molecule and a molecular weight of less than 300. Preferably, the compositions of the present invention less than about 1.0% of such ingredients. More preferably, the compositions of the present invention include less than about 0.35% of such ingredient, and most preferably less than about 0.001% of such ingredients.

Another embodiment of the invention is a process of treating a metal with a composition as described above. In this embodiment of the invention, the metal to be treated is contacted with the compositions of the present invention. Preferably, the temperature at which the metal is contacted is from about 25° C. to about 90° C. More preferably, the contacting temperature is from about 33° C. to about 75° C., and most preferably from about 40° C. to 50° C. The time of contact between a working composition according to the invention and a metal substrate to be treated preferably is from about 0.2 to about 1800 seconds. More preferably, the time of contact is from about 2 seconds to about 50 seconds, and most preferably from about 3 to 6 seconds. Independently, it is preferred that the metal surface thus treated be subsequently rinsed with water in one or more stages before being dried. More preferably, the metal surface is rinsed with a final rinse of an aqueous organic hydroxylate. Preferably, the final rinse is with a partially neutralized tannic acid rinse. A particularly preferred rinse is Parcolene 88A which is commercially available from Henkel Surface Technology. Also in this embodiment, it is usually fully satisfactory to allow the treated and rinsed substrate to dry spontaneously in air at a normal ambient temperature of about 17° C. to about 27° C. If faster drying is desired, any convenient method, of which many are known per se in the art, may be used; examples are hot air and infrared radiative drying. However, it is preferred that the maximum temperature of the metal reached during drying not exceed about 200° C., more preferably about 75° C. and most preferably about 35° C. Furthermore, it is preferred that drying be completed in less than about 15 minutes, more preferably in less than about 1 minutes, and most preferably less than about 5 seconds after the last contact of the treated metal with an aqueous liquid before drying is completed.

As noted above, the treatment compositions according to the invention preferably contain titanium, and when they do, it is preferred that the amount of titanium deposited on a treated metal surface by treatment according to the invention is from about 0.05 milligrams per square meter to about 300 milligrams per square meter. More preferably, the amount of titanium deposited is from about 0.25 milligrams per square meter (hereinafter usually abbreviated as "$mg/m^2$) to about 100 $mg/m^2$; and most preferably from about 1.5 milligrams $mg/m^2$ to about 7 $mg/m^2$.

When the compositions of the present invention are repeatedly contacted with metal to be treated, it is necessary to add a replenisher to the working solution in order to maintain all components within their optimal ranges. Such replenisher compositions include water, a fluoroacid, a pH adjusting component, a water soluble organic carboxylic acid, and an inorganic acid that has fluorine. Each of these components for the replenisher are the same as set forth above. A particularly preferred replenisher includes from 1% to 10% of a 50% aqueous $H_2TiF_6$ aqueous solution, 1% to 10% of a 20% aqueous $H_2ZrF_6$ solution, 5% to 20% of a 67% aqueous nitric acid solution, about 5% to about 20% ammonium bifluoride, about 10% to 30% of a 49% aqueous hydrofluoric acid solution, about 0.5 to about 6% of a 75% aqueous phosphoric acid, and about 5% to about 20% of a 50% aqueous gluconic acid (all percentages are weight percentages.)

In another embodiment of the present invention, a concentrated make-up composition and a concentrated organic composition are provided. These compositions are combined together with water to form the working solution of the present invention. The make-up composition preferably includes water, the fluoroacid, and the source of phosphate ions. Optionally, the make-up composition also includes the water soluble organic carboxylic acid, the metal containing component, a pH adjusting component, an inorganic acid that has fluorine, and an anti-foaming agent. Each of these components for the make-up composition as the same as set forth above for the except that each component other than water is present in approximately 10 times higher concentration. The concentrated organic composition includes water, the fluoroacid, and the polymer component. The polymer component is preferably in a concentration that is 100 times higher than the concentration set forth above for the working composition.

Preferably, any make-up, organic, or replenisher concentrate has at least 2% ingredients other than water. More preferably, such concentrates have at least 4% ingredients other than water, and most preferably at least 5.7% ingredients other than water.

A process according to the invention as generally described in its essential features above may be, and usually preferably is, continued by coating the dried metal surface produced by the treatment as described above with a siccative coating or other protective coating, which is relatively thick compared with the coating formed by the earlier stages of a process according to the invention as described above. Such protective coatings may generally, in connection with this invention, be selected and applied as known per se in the art. Surfaces thus coated have been found to have excellent resistance to subsequent corrosion. Particularly preferred types of protective coatings for use in conjunction with this invention include vinyl, acrylic, epoxy, and polyester based paints, enamels, lacquers, and the like.

In a process according to the invention that includes other steps after the formation of a treated layer on the surface of a metal as described above and that operates in an environment in which the discharge of hexavalent chromium is either legally restricted or economically handicapped, it is generally preferred that none of these other steps include contacting the surfaces with any composition that contains more than about 1%, more preferably more than about 0.1%, and most preferably more than about 0.0002% hexavalent chromium. Examples of suitable and preferred chromium free treatments are described in U.S. Pat. No. 4,963,596.

Preferably, the metal surface to be treated according to the invention is first cleaned of any contaminants, particularly organic contaminants and foreign metal fines and/or inclusions. Such cleaning may be accomplished by methods known to those skilled in the art and adapted to the particular type of metal substrate to be treated. For example, for aluminum, the surface to be treated most preferably is first contacted with a conventional hot alkaline cleaner, then rinsed in hot water, then, optionally, contacted with a neutralizing acid rinse, before being contacted with an acid aqueous composition according to this invention as described above.

The practice of this invention may be further appreciated by consideration of the following, non-limiting, working examples.

Test Methods

1. Cross Hatch Test

The "Cross Hatch" provides a measure of the ability of a coating to adhere to a surface. The Cross Hatch test is performed by:

1. Forming a crosshatched area by making two perpendicular cuts on a coated sample with a Gardener crosshatch tool. A Gardener crosshatch tool having 11 knife edges spaced 1.5 mm apart was used.

2. Firmly applying #610 Scotch™ tape to the crosshatched area and removing the tape.

3. Examining the crosshatched area for paint not removed by the tape and report a number related to the percentage of paint remaining. The scale provided in Table 1 was used for recording the results of the Cross Hatch test.

TABLE 1

Scale used for Cross Hatch Test

| Observation | Cross Hatch Rating |
|---|---|
| perfect | 0 |
| very slight pickoff from square edges | 1 |
| slight pickoff (1–2%) | 2 |
| moderate pickoff (2–50%) | 3 |
| severe pickoff (>50%) | 4 |
| very severe, crosshatching removes the lacquer | 5 |

2. Feathering Test

The "Feathering" test was performed as follows: Using a utility knife, a slightly curved "V" is scribed on the back side of the test panel. Using scissors, cut up about 12 millimeters (hereinafter "mm") from the bottom along the scribe. Bend the inside of the V away from the side for testing. Place the sample in a vise and, using pliers, pull from the folded section with a slow continuous motion. Ignore the part of the panel between the top edges nearest to the vertex and a line parallel to the top edge but 19 mm away from it. On the remainder of the panel, measure to edge of feathering in mm. Record the largest value observed.

3. Blushing

Blushing was determined by evaluating coated samples for haziness according the scale provided in Table 2.

TABLE 2

Scale for Blushing

| Observation | Blushing Scale |
|---|---|
| perfect | 0 |
| very slight haze on surface | 1 |
| slightly clouding appearance | 2 |
| moderate cloudy appearance | 3 |
| very cloudy and dull appearance, possible discoloration | 4 |

The Cross Hatch, Blushing, and Feathering tests were made after exposing test panels to various aqueous environments as follows:

Dowfax Immersion

"15 Minute Boiling DOWFAX™ 2A1 Immersion" (abbreviated "Boiling Dowfax™ Sol'n") means boiling for 15 minutes in a 1.67% by volume of DOWFAX™ 2A1 in deionized water; then removing the panels, rinsing with water, and drying. DOWFAX™ 2A1 is commercially available from Dow Chemical and is described by the supplier as 45% active sodium dodecyl diphenyloxide disulfonate in water.

MSE Immersion

Samples were immersed in a MSE solution having the following composition: 2% glacial acetic acid by volume, 3% by volume of an 85% lactic acid in water, and 3% by weight sodium chloride. Samples were also evaluated by immersion in a "Half MSE" solution which is formed by diluting the MSE solution by 50% by adding water.

Aluminum test samples were cleaned with a Parco™ Cleaner 305 (2.5% by volume) for 10 seconds at 140° F., followed by a warm water rinse for 10 seconds. The samples were then treated for 3–5 seconds at a temperature of about 125° F. to about 140° F. with a working composition formed by 10% of the composition in Table 3 and 3% of the concentration composition of Table 4 with the balance deionized water. In Table 4, the polymer solution is formed by the process of U.S. Pat. No. 4,963,596, col. 11, ll. 39–46. The preparation was carried out on a substantially larger scale; the proportions of ingredients were changed to the following: 241 parts of Propasol™ P, 109 parts of Resin M, 179 parts of N-methylglucamine, 73.5 parts of aqueous 37% formaldehyde, and 398 parts of deionized water, of which 126 parts were reserved for a final addition not described in the noted patent, with the remainder used to slurry the N-methylglucamine as noted in the patent. The polymer composition contains about 30% by weight solids (i.e., about 30% by weight is polymeric material.) The samples were then rinsed with deionized water for about 5 seconds. The aluminum samples were immediately after treatment coated with EZ Dex lacquer commercially available from Valspar Corporation. The lacquer was applied to the test samples and cured for 14–15 seconds in an over at 650° F. sufficient to achieve a peak metal temperature of 450° F. A sufficient amount of lacquer to achieving a coating amount of about 6.5 mg/in$^2$ to about 8.5 mg/in$^2$ was applied. The feathering, cross-hatch ("X-hatch), and blush results for these samples are provided in Table 5. The pH of the working composition formed from the combination of the concentrates in Tables 3 and 4 is also provided in Table 5. Although the tested samples showed acceptable results for the DF cross-hatch, blush, and feathering, the MSE cross-hatch performance is unacceptably high.

TABLE 3

| Component | weight % |
|---|---|
| 50% $H_2TiF_6$ | 2.1 |
| 20% $H_2ZrF_6$ | 6.45 |
| 67.25% nitric acid | 6.69 |
| gluconic acid | 0.9 |
| $NH_4OH$ | 5.7 |
| deionixed water | 78.16 |

TABLE 4

| Component | weight % |
|---|---|
| 50% $H_2TiF_6$ | 2.1% |
| polymer solution | 16.65 |
| deionized water | 81.25 |

TABLE 5

| pH | coating weight (Ti) (mg/ft$^2$) | DF X-hatch | DF Blush | DF feathering | MSE X-hatch | MSE Blush |
|---|---|---|---|---|---|---|
| 3.15 | 0.33 | 0 | 2 | 0.05 | 4.5 | 3 |
| 3.23 | 0.33 | 0 | 2 | 0.05 | 4.5 | 3 |

A second group of aluminum samples were cleaned with a Parco™ Cleaner 305 (2.5% v/v) for 10 seconds at 140° F., followed by a warm water rinse for 10 seconds. The performance of these samples is provided in Table 6. The samples were then treated with a composition formed by 10% of the composition in Table 3 and 1% of the concentration composition of Table 4 with the balance water with varying amounts of phosphoric acid for 3–5 seconds at a temperature from about 125 to 130° F. The samples were than rinsed with deionized water for about 5 seconds. The aluminum samples were immediately after treatment coated with EZ Dex lacquer in a sufficient amount to achieve a lacquer coating of about 6.5 mg/in$^2$ to about 8.5 mg/in$^2$. Table 6 provides feathering, cross-hatch, and blush for this second group of samples. The lacquer was applied with to the test samples and cured for 14–15 seconds in an over at 650° F. sufficient to achieve a peak metal temperature of 450° F. For these samples, the MSE cross-hatch performance is somewhat improved over the samples in Table 5 which were not treated with a phosphate containing composition. In particular, the samples treated with a composition having from 4 to 7 ml of 75% phosphoric acid per 6 liters of working composition were found to have significantly better MSE X-hatch performance than the samples in Table 5 that had no phosphate.

TABLE 6

| ml of 75% $H_3PO_4$ per 6 liters | pH | coating weight (Ti) (mg/ft$^2$) | DF Xhatch | DF Blush | DF feathering | MSE X-hatch | MSE Blush | Half MSE x-hatch | Half MSE blush |
|---|---|---|---|---|---|---|---|---|---|
| 1 | 2.27 | 0.46 | 0 | 3 | 0.5 | 0.5 | 2 | | |
| 1 | 3.22 | 0.43 | 0 | 3 | 0.1 | 2.5 | 3 | | |
| 1 | 2.28 | 0.34 | 0 | 3 | 0.05 | 4 | 2 | | |
| 1 | 3.28 | 0.31 | 0 | 3 | 0.05 | 3.5 | 3 | | |
| 1 | 2.24 | 0.33 | 0 | 1.5 | 0.1 | 4.5 | 2.5 | 2.5 | 2.5 |
| 1 | 3.21 | 0.36 | 0 | 2 | 0.075 | 5 | 1.5 | 4 | 2 |
| 1 | 2.44 | 0.37 | 0 | 2.5 | 0.075 | 4.5 | 2 | 4 | 2 |
| 2.5 | 2.41 | 0.42 | 0 | 1.5 | 0.125 | 2.5 | 3 | 1 | 2 |
| 2.5 | 2.25 | 0.56 | 0 | 3.5 | 0.6 | 4.5 | 4 | 0 | 3 |
| 2.5 | 3.19 | 0.35 | 0 | 3 | 0.1 | 4.5 | 1.5 | 1.5 | 2 |
| 2.5 | 2.5 | 0.45 | 0 | 3 | 0.125 | 1.5 | 2.5 | 0 | 2.5 |
| 2.5 | 2.49 | 0.44 | 0 | 3 | 0.075 | 3.5 | 3 | 0 | 2.5 |
| 2.5 | 2.42 | 0.33 | 0 | 1 | 0.1 | 1.5 | 2 | 0 | 2 |
| 2.5 | 2.48 | 0.55 | 0 | 2 | 0.1 | 1 | 1.5 | 0 | 2 |
| 4 | 2.45 | 0.51 | 0 | 2 | 0.075 | 0 | 2 | 0 | 1.5 |
| 4 | 2.26 | 0.55 | 0 | 1.5 | 0.1 | 3 | 3 | 0 | 2 |
| 4 | 3.2 | 0.33 | 0 | 2 | 0.05 | 1.5 | 3 | 0 | 2.5 |
| 7 | 2.25 | 0.57 | 0 | 3 | 0.1 | 0 | 3 | | |
| 7 | 3.15 | 0.33 | 0 | 3 | 0.05 | 0 | 2 | | |
| 7 | 2.3 | 0.62 | 0 | 3 | 0.15 | 0 | 3 | | |
| 7 | 3.18 | 0.33 | 0 | 2 | 0.1 | 0 | 2 | | |

Table 7 provides feathering, cross-hatch, and blush results for aluminum samples cleaned with a Parco™ Cleaner 305 (2.5% by volume in water) for 10 seconds at 140° F., followed by warm water rinse for 10 seconds. The samples were then treated with a composition formed by 10% of the composition in Table 3 and 1% of the concentration composition of Table 4 with the balance deionized water with varying amounts of phosphoric acid for 3–5 seconds at a temperature from about 125 to 130° F. The samples were next cold water rinse for 5 seconds and then rinsed with a solution having 1% by volume Parcolene 88A. The aluminum samples were immediately after treatment coated with EZ Dex lacquer in a sufficient amount to achieve a lacquer coating of about 6.5 mg/in$^2$ to about 8.5 mg/in$^2$. The lacquer was applied to the test samples and cured for 14–15 seconds in an over at 650° F. sufficient to achieve a peak metal temperature of 450° F. Table 7 demonstrates that the combination of both increased phosphate and rinsing with the Parcolene 88A rinse provides better MSE cross-hatch performance than samples not treated with a phosphate containing composition or samples that were treated with a phosphate containing composition but processed with a final deionized water rinse.

TABLE 7

| ml of $H_3PO_4$ per 6 liters | pH | coating weight (Ti) (mg/ft$^2$) | DF X-hatch | DF Blush | DF feathering | MSE X-hatch | MSE Blush | Half MSE X-hatch | Half MSE Blush |
|---|---|---|---|---|---|---|---|---|---|
| 1 | 2.27 | 0.35 | 0 | 3 | 0.1 | 0 | 3 | | |
| 1 | 3.16 | 0.35 | 0 | 3 | 0.05 | 0.5 | 3 | | |
| 1 | 2.29 | 0.61 | 0 | 3 | 0.1 | 0 | 3 | | |
| 1 | 3.3 | 0.32 | 0 | 3 | 0.1 | 0 | 3 | | |
| 1 | 2.53 | 0.5 | 0 | 3 | 0.075 | 2 | 2.5 | 0 | 2 |
| 1 | 3.16 | 0.35 | 0 | 1.5 | 0.1 | 4 | 2.5 | 1.5 | 2 |
| 1 | 2.26 | 0.37 | 0 | 3 | 0.05 | 2 | 1.5 | 0 | 1 |
| 2.5 | 2.18 | 0.48 | 0 | 1.5 | 0.125 | 0 | 3 | 0 | 2 |
| 2.5 | 2.52 | 0.33 | 0 | 2 | 0.225 | 2 | 3 | 0 | 2.5 |
| 2.5 | 2.53 | 0.32 | 0 | 3 | 0.1 | 0 | 2 | 0 | 2 |
| 2.5 | 3.2 | 0.38 | 0 | 3 | 0.125 | 0 | 2 | 0 | 2 |
| 2.5 | 2.4 | 0.5 | 0 | 1.5 | 0.125 | 1.5 | 3 | 0 | 2.5 |
| 2.5 | 2.42 | 0.48 | 0 | 2 | 0.125 | 0 | 2.5 | 0 | 1.5 |
| 2.5 | 2.51 | 0.47 | 0 | 3 | 0.1 | 3 | 4 | 0 | 2.5 |
| 4 | 3.16 | 0.41 | 0 | 3 | 0.125 | 1.5 | 2.5 | 0 | 2 |
| 4 | 2.23 | 0.52 | 0 | 1.5 | 0.1 | 0 | 2.5 | 0 | 2 |
| 4 | 2.4 | 0.46 | 0 | 1.5 | 0.15 | 1.5 | 3 | 0 | 3 |
| 7 | 2.22 | 0.61 | 0 | 2 | 0.15 | 1.5 | 3 | | |
| 7 | 3.14 | 0.34 | 0 | 3 | 0.05 | 0 | 2 | | |

TABLE 7-continued

| ml of $H_3PO_4$ per 6 liters | pH | coating weight (Ti) (mg/ft$^2$) | DF X-hatch | DF Blush | DF feathering | MSE X-hatch | MSE Blush | Half MSE X-hatch | Half MSE Blush |
|---|---|---|---|---|---|---|---|---|---|
| 7 | 2.22 | 0.48 | 0 | 3 | 0.05 | 0 | 3 | | |
| 7 | 3.23 | 0.43 | 0 | 3 | 0.1 | 0 | 3 | | |

Table 8 provides feathering, cross-hatch, and blush results for aluminum samples cleaned with a Parco™ Cleaner 305 (2.5% by volume in water) for 10 seconds at 140° F., followed by warm water rinse for 10 seconds. The samples were then treated with a composition formed by 10% of the composition in Table 3 and 1% of the concentration composition of Table 4 with the balance deionized water with varying amounts of phosphoric acid for 3–5 seconds at a temperature from about 125 to 130° F. The samples were next cold water rinse for 5 seconds and then rinsed with a solution having varying amount of Parcolene 88A. The aluminum samples were immediately after treatment coated with EZ Dex lacquer in a sufficient amount to achieve a lacquer coating of about 6.5 mg/in$^2$ to about 8.5 mg/in$^2$. The lacquer was applied to the test samples and cured for 14–15 seconds in an over at 650° F. sufficient to achieve a peak metal temperature of 450° F. Table 8 again demonstrates that the combination of both increased phosphate and rinsing with the Parcolene 88A rinse provides better MSE cross-hatch performance than samples not treated with a phosphate containing composition or samples that were treated with a phosphate containing composition but processed with a final deionized water rinse. Optimal performance with respect to the MSE test was achieved with Parcolene 88A concentrations from about 0.625% to about 1% in water.

TABLE 8

| ml of $H_3PO_4$ per 6 liters | % Parcolene 88A | pH | coating weight (Ti) (mg/ft$^2$) | DF X-hatch | DF feathering | MSE X-hatch |
|---|---|---|---|---|---|---|
| 2.5 | 0.25 | 2.5 | 0.32 | 0 | 0.15 | 3.5 |
| 2.5 | 0.25 | 2.5 | 0.59 | 0 | 0.075 | 0 |
| 2.5 | 0.25 | 2.29 | 0.5 | 0 | 0.1 | 0 |
| 2.5 | 0.625 | 3.29 | 0.3 | 0 | 0.125 | 2 |
| 2.5 | 0.625 | 2.5 | 0.37 | 0 | 0.175 | 4 |
| 2.5 | 0.625 | 2.4 | 0.45 | 0 | 0.175 | 2 |
| 2.5 | 1 | 2.29 | 0.42 | 0 | 0.15 | 1.5 |
| 2.5 | 1 | 2.5 | 0.32 | 0 | 0.125 | 2 |
| 2.5 | 1 | 2.5 | 0.42 | 0 | 0.075 | 4 |
| 4.25 | 0.25 | 2.4 | 0.34 | 0 | 0.125 | 2.5 |
| 4.25 | 0.25 | 2.29 | 0.6 | 0 | 0.125 | 0 |
| 4.25 | 0.25 | 3.19 | 0.49 | 0 | 0.075 | 0 |
| 4.25 | 0.625 | 4.25 | 0.46 | 0 | 0.2 | 0.5 |
| 4.25 | 0.625 | 4.25 | 0.42 | 0 | 0.175 | 1.5 |
| 4.25 | 0.625 | 3.21 | 0.59 | 0 | 0.125 | 2.5 |
| 4.25 | 0.625 | 2.41 | 0.34 | 0 | 0.15 | 0 |
| 4.25 | 0.625 | 2.29 | 0.47 | 0 | 0.15 | 0 |
| 4.25 | 0.625 | 2.44 | 0.45 | 0 | 0.125 | 0.5 |
| 4.25 | 0.625 | 2.43 | 0.58 | 0 | 0.1 | 0 |
| 4.25 | 0.625 | 2.4 | 0.46 | 0 | 0.125 | 0 |
| 4.25 | 1 | 3.24 | 0.35 | 0 | 0.1 | 0 |
| 4.25 | 1 | 2.26 | 0.45 | 0 | 0.15 | 0.5 |
| 4.25 | 1 | 2.29 | 0.59 | 0 | 0.075 | 0 |
| 6 | 0.25 | 2.42 | 0.38 | 0 | 0.2 | 1 |
| 6 | 0.25 | 2.26 | 0.51 | 0 | 0.2 | 2 |
| 6 | 0.25 | 3.22 | 0.42 | 0 | 0.075 | 1.5 |

TABLE 8-continued

| ml of $H_3PO_4$ per 6 liters | % Parcolene 88A | pH | coating weight (Ti) (mg/ft$^2$) | DF X-hatch | DF feathering | MSE X-hatch |
|---|---|---|---|---|---|---|
| 6 | 0.625 | 3.16 | 0.31 | 0 | 0.075 | 0.5 |
| 6 | 0.625 | 2.4 | 0.42 | 0 | 0.15 | 0 |
| 6 | 0.625 | 2.26 | 0.43 | 0 | 0.125 | 1.5 |
| 6 | 1 | 3.19 | 0.53 | 0 | 0.075 | 0 |
| 6 | 1 | 2.41 | 0.31 | 0 | 0.125 | 2 |
| 6 | 1 | 2.21 | 0.57 | 0 | 0.125 | 0.5 |

Tables 9 and 10 provides feathering, cross-hatch, and blush results for aluminum samples cleaned with a Parco™ Cleaner 305 (2.5% by volume in water) for 10 seconds at 140° F., followed by warm water rinse for 10 seconds. The samples were then treated with a composition formed by 10% of the composition in Table 3 and 1% Bonderite 785-O with varying amounts of phosphoric acid for 3–5 seconds at a temperature from about 125 to 130° F. Bonderite 785-O is a 0.62% dried chestnut tannin composition commercially available from Henkel Surface Technologies. The samples were next cold water rinse for 5 seconds and a final rinse, Table 9 provides results where the final rinse was a deionized water rinse, while table 10 provides results for when the final rinse is with an aqueous solution of 1% Parcolene 88A. The aluminum samples were immediately after treatment coated with EZ Dex lacquer in a sufficient amount to achieve a lacquer coating of about 6.5 mg/in$^2$ to about 8.5 mg/in$^2$. The lacquer was applied to the test samples and cured for 14–15 seconds in an over at 650° F. sufficient to achieve a peak metal temperature of 450° F. Tables 9 and 10 again demonstrates that the combination of both increased phosphate and rinsing with the Parcolene 88A rinse consistently provides better MSE cross-hatch performance than samples not treated with a phosphate containing composition or samples that were treated with a phosphate containing composition but processed with a final deionized water rinse. Optimal performance with respect to the MSE test was achieved with Parcolene 88A concentrations from about 0.625% to about 1% in water.

TABLE 9

| ml of 75% $H_3PO_4$ per 6 liters | pH | coating weight (Ti) (mg/ft$^2$) | DF Xhatch | DF Blush | DF feathering | MSE X-hatch | MSE Blush | Half MSE x-hatch | Half MSE blush |
|---|---|---|---|---|---|---|---|---|---|
| 0 | 2.66 | 0.46 | 0 | 1 | 0.1 | 5 | 1 | 4 | 2 |
| 7 | 2.62 | 0.58 | 0 | 1 | 0.2 | 3 | 1 | 0 | 2 |

TABLE 10

| ml of 75% $H_3PO_4$ per 6 liters | pH | coating weight (Ti) (mg/ft$^2$) | DF Xhatch | DF Blush | DF feathering | MSE X-hatch | MSE Blush | Half MSE x-hatch | Half MSE blush |
|---|---|---|---|---|---|---|---|---|---|
| 0 | 2.66 | 0.46 | 0 | 1 | 0.15 | 3 | 2 | 0 | 2 |
| 7 | 2.62 | 0.58 | 0 | 1 | 0.15 | 0 | 2 | 0 | 2 |

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An aqueous liquid composition that is suitable either as such or after dilution with water for treating metal surfaces to improve the corrosion resistance thereof, said composition comprising water and:

a fluoroacid selected from the group consisting of $H_2TiF_6$, $H_2ZrF_6$, $H_2HfF_6$, $H_2SiF_6$, $H_3AlF_6$, $H_2GeF_6$, $H_2SnF_6$, $HBF_4$, and mixtures thereof;

a water soluble organic carboxylic acid that has at least two hydroxyl groups, exclusive of the hydroxyl groups that are part of any carboxyl groups, per carboxyl group in each acid molecule and the water soluble salts of such acids;

a source of phosphate ions; and an amino-phenolic polymer component.

2. The composition of claim 1 wherein the fluoroacid is a mixture of $H_2TiF_6$ and $H_2ZrF_6$.

3. The composition of claim 1 wherein the fluoroacid is present in an amount of about 0.5 mM to about 100 mM.

4. The composition of claim 1 wherein the fluoroacid is present in an amount of about 3 mM to about 50 mM.

5. The composition of claim 1 wherein the water soluble organic carboxylic acid is gluconic acid.

6. The composition of claim 1 wherein the water soluble organic carboxylic acid is present in an amount of about 0.1 mM to about 20 mM.

7. The composition of claim 1 wherein the water soluble organic carboxylic acid is present in an amount of about 1 mM to about 10 mM.

8. The composition of claim 1 wherein the source of phosphate is selected from the group consisting of phosphoric acid, orthophosphoric acid, sodium phosphate, and mixtures thereof.

9. The composition of claim 1 wherein the source of phosphate is present in an amount of about 0.5 mM to about 20 mM.

10. The composition of claim 1 wherein the source of phosphate is present in an amount of about 5 mM to about 15 mM.

11. The composition of claim 1 wherein the amino-phenolic polymer component comprising water soluble and water dispersible polymers and copolymers of one or more x-(N—$R^1$—N—$R^2$-aminomethyl)-4-hydroxy-styrenes, where x=2, 4, 5, or 6, $R^1$ represents an alkyl group containing from 1 to 4 carbon atoms, preferably a methyl group, and $R^2$ represents a substituent group conforming to the general formula $H(CHOH)_nCH_2$—, where n is an integer from 1 to 7, preferably from 3 to 5.

12. The composition of claim 11 wherein the amino-phenolic polymer component is present in an amount of about 4.5 mg to about 3000 mg for each liter of a working composition.

13. The composition of claim 11 further comprising a tannin is selected from the group consisting of hydrolyzable tannins, condensed tannins, vegetable tannins, and mixtures thereof.

14. The composition of claim 1 further comprising a component selected from the group consisting of:

a metal-containing compound selected from the group consisting of the elements Ti, Zr, Hf, Al, Si, Ge, Sn, and B and the oxides, hydroxides, and carbonates of all of these elements;

a pH adjusting component selected from the group consisting of inorganic acids and inorganic alkaline materials that do not contain fluorine; and a metal-containing component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates;

an inorganic acid that contains fluorine but do not contain any of the elements Ti, Zr, Hf, Al, Si, Ge, Sn, and B; an anti-foaming agent; and mixtures thereof.

15. The composition of claim 14 wherein the pH adjusting component is added in a sufficient amount to set the pH at a value from about 1.2 to about 4.5.

16. The composition of claim 14 wherein the pH adjusting is an inorganic acid that does not contain fluoride or an inorganic alkaline material that does not contain fluorine.

17. The composition of claim 14 wherein the inorganic acid that contains fluorine but do not contain any of the elements Ti, Zr, Hf, Al, Si, Ge, Sn, and B is selected from the group consisting of sulfuric acid, hydrochloric acid, and nitric acid.

18. A process of treating a metal surface, said process comprising steps of:

a) contacting a metal substrate selected from the group consisting of iron and steel, galvanized iron and steel, zinc and those of its alloys that contain at least 50 atomic percent zinc, and aluminum and its alloys that contain at least 50 atomic percent aluminum with a composition according to claim 1 for a time in the range from about 3 to about 50 seconds and at a temperature from about 25° C. to about 90°C.

19. The process of claim 18 further comprising:

b) contacting the metal surface with partially neutralized tannic acid rinse.

20. The method of claim 18 further comprising:

c) allowing the metal surface treated in step b to dry; and d) overcoating the dried surface from step c with a protective coating selected from the group consisting of vinyl, acrylic, epoxy and polyester based paints, enamels, and lacquers.

21. The method of claim 18, wherein the treated metal substrate includes aluminum or a zinc-aluminum alloy.

22. An article of manufacture made by a process according to claim 18.

23. A process of treating a metal surface, said process comprising steps of:

a) contacting a metal substrate selected from the group consisting of iron and steel, galvanized iron and steel, zinc and those of its alloys that contain at least 50 atomic percent zinc, and aluminum and its alloys that contain at least 50 atomic percent aluminum with a composition according to claim 11 for a time in the range from about 2 to about 50 seconds and at a temperature from about 25° C. to about 90°C.

24. The process of claim 23 further comprising:

b) contacting the metal surface with partially neutralized tannic acid rinse.

25. The method of claim 24 further comprising:

c) allowing the metal surface treated in step b to dry; and d) overcoating the dried surface from step c with a protective coating selected from the group consisting of vinyl, acrylic, epoxy and polyester based paints, enamels, and lacquers.

26. The method of claim 25, wherein the treated metal substrate includes aluminum or a zinc-aluminum alloy.

27. An article of manufacture made by a process according to claim 23.

28. The composition of claim 11 further comprising a tannin.

29. An aqueous liquid composition that is suitable either as such or after dilution with water for treating metal surfaces to improve the corrosion resistance thereof, said composition comprising water and:

a fluoroacid selected from the group consisting of $H_2TiF_6$, $H_2ZrF_6$, $H_2HfF_6$, $H_2SiF_6$, $H_3AlF_6$, $H_2GeF_6$, $H_2SnF_6$, $HBF_4$, and mixtures thereof, the fluoroacid being present in an amount from about 3 mM to about 50 mM;

a water soluble organic carboxylic acid that has at least two hydroxyl groups, exclusive of the hydroxyl groups that are part of any carboxyl groups, per carboxyl group in each acid molecule and the water soluble salts of such acids;

a source of phosphate ions; and an amino-phenolic polymer component.

30. An aqueous liquid composition that is suitable either as such or after dilution with water for treating metal surfaces to improve the corrosion resistance thereof, said composition consisting essentially of water and:

a fluoroacid selected from the group consisting of $H_2TiF_6$, $H_2ZrF_6$, $H_2HfF_6$, $H_2SiF_6$, $H_3AlF_6$, $H_2GeF_6$, $H_2SnF_6$, $HBF_4$, and mixtures thereof;

a water soluble organic carboxylic acid that has at least two hydroxyl groups, exclusive of the hydroxyl groups that are part of any carboxyl groups, per carboxyl group in each acid molecule and the water soluble salts of such acids;

a source of phosphate ions; and an amino-phenolic polymer component.

* * * * *